United States Patent [19]

Curiel

[11] Patent Number: 4,928,837

[45] Date of Patent: May 29, 1990

[54] TAMPER EVIDENT CLOSURE

[75] Inventor: Yoram Curiel, Aurora, Colo.

[73] Assignee: TSL Incorporated, Aurora, Colo.

[21] Appl. No.: 347,363

[22] Filed: May 4, 1989

[51] Int. Cl.[5] ..... B65D 51/00

[52] U.S. Cl. ..... 215/250; 215/230

[58] Field of Search ..... 215/230, 235, 250, 253, 215/365, 203, 224, 225; 206/459, 807; 220/265, 266

[56] References Cited

U.S. PATENT DOCUMENTS

| | | | |
|---|---|---|---|
| 1,664,635 | 4/1928 | Magill . | |
| 2,074,490 | 3/1937 | Schwartz . | |
| 2,127,548 | 8/1938 | Boyle et al. . | |
| 2,131,774 | 10/1938 | Waring . | |
| 3,415,402 | 12/1968 | Webber . | |
| 3,662,915 | 5/1972 | Destler, Jr. . | |
| 3,783,089 | 1/1974 | Hurst et al. . | |
| 3,786,777 | 1/1974 | Smith et al. . | |
| 3,935,960 | 2/1976 | Cornell | 220/265 |
| 4,012,553 | 3/1977 | Clemens | 428/285 |
| 4,098,577 | 7/1978 | Halpern | 206/459 X |
| 4,181,223 | 1/1980 | Millet | 220/265 X |
| 4,424,252 | 1/1984 | Nativi | 428/209 |
| 4,436,203 | 3/1984 | Reyner | 206/807 |
| 4,449,632 | 5/1984 | Marusiak, Jr. | 206/807 |
| 4,451,523 | 5/1984 | Nativi et al. | 428/209 |
| 4,479,585 | 10/1984 | Sandhaus | 215/250 X |
| 4,502,605 | 3/1985 | Wloszczyna | 215/230 |
| 4,505,399 | 3/1985 | Weiner | 215/230 |
| 4,516,679 | 5/1985 | Simpson et al. | 206/459 |
| 4,546,881 | 10/1985 | Tasma | 206/459 |
| 4,566,627 | 1/1986 | Gendron | 206/807 |
| 4,576,297 | 3/1986 | Larson | 215/250 |
| 4,718,553 | 1/1988 | Adamoli et al. | 206/459 |
| 4,747,499 | 5/1988 | Gach et al. | 215/250 |
| 4,749,084 | 6/1988 | Pereyra | 206/459 |
| 4,759,445 | 7/1988 | McVay | 206/524.2 |

*Primary Examiner*—Steven M. Pollard

*Attorney, Agent, or Firm*—Arnold B. Silverman

[57] ABSTRACT

The tamper evident closure is a resilient closure which is snap fit onto a container. The resilient closure has an end wall with a plurality of transverse grooves. A resin is deposited on the top surface of the end wall and into the grooves. If the closure is moved away from the container, the top layer of resin and a portion of the resin in the grooves will fracture, thus indicating to the consumer that tampering with the container has occurred. A portion of the resin will remain in the grooves to indicate that the resin was applied when the closure was initially sealed. In another embodiment, the closure comprises a rotatable portion and a fixed portion. The rotatable and fixed portion have grooves which contain a resin. When the rotatable portion is pivoted away fromt he fixed portion to open the container, a portion of the resin fractures, thus indicating tampering with the container. A portion of the resin also remains in the grooves.

23 Claims, 5 Drawing Sheets

TAMPER EVIDENT CLOSURE

BACKGROUND OF THE INVENTION

1. Field of the Invention

This invention relates to a tamper evident closure, and more specifically, it relates to a closure having a resin applied to the exterior thereof which will not only indicate if tampering has occurred, but will also indicate whether the tamper evident resin was in fact applied to the product by the manufacturer.

2. Description of the Prior Art

The tampering with and adulteration of many commercially available products have become critical problems endangering health and destroying purity of many products. Many products which are adulterated or tampered with ultimately reach a consumer bearing no visible indication that such adulteration or tampering has occurred. Accordingly, it is highly desirable to provide a type of packaging that will provide an indication that there has been interference with the integrity of the product packaging.

Various types of mechanical indicators used to determine the integrity of several types of products and containers are known.

U.S. Pat. No. 3,662,915 relates to a tamperproof package which provides a recessed tab in the inner periphery of a container which breaks away from the remainder of the container when entry is made into the container. This serves to indicate that tampering with the package has occurred.

U.S. Pat. No. 2,131,774 discloses a closure having a sealing liner. A disc of fibrous material is placed between the closure and the sealing liner. When the closure is removed, the disc will rupture the closing liner. See also, U.S. Pat. Nos. 4,576,297 and 4,747,499.

It has been known to provide for rupturing of outer coatings which fracture responsive to operation of a container tear strip. See U.S. Pat. No. 3,415,402. See also U.S. Pat. No. 4,479,585.

U.S. Pat. No. 4,749,084 discloses a tamper-indicating package having a web formed from two coextensive webs. Each web contains an outer layer, an inner sealable layer and an intermediate layer comprising filaments. The filaments are disposed in a random manner, thus, each package has its own unique "fingerprint". In use, the sender of the package can prepare an image of the package and send this image to the recipient of the package. In order to determine whether the package has been tampered with, the recipient can compare the images prepared by the sender with the arrangements of the filaments in the package.

My earlier U.S. Pat. Application Ser. No. 07/209,822 filed June 22, 1988, the disclosure of which is expressly incorporated herein by reference, discloses a tamper resistant package and a method of making the same. An outer protective layer of an epoxide resin is placed on a package and is subsequently cured by ultraviolet radiation. This causes the outer layer to become extremely brittle such that any physical penetration of the outer layer will cause the entire outer layer to fracture. Such fracturing will provide a clear visual indication that penetration of the outer layer has occurred as by cracking of the material and separation of the pieces from the package.

In spite of the existing prior art techniques, there remains a need for an effective method of indicating that a closure has been tampered with or adulterated.

There also remains a need for a closure to indicate whether or not the tamperproofing means has been placed on the closure by the manufacturer.

SUMMARY OF THE INVENTION

The present invention has met the above-described need. In one embodiment, a resilient closure is snap fit onto the container. The resilient closure has an end wall provided with a plurality of transverse grooves. A resin is deposited on the top surface of the end wall and into the grooves. If the closure is removed from the container, the top layer of resin and a portion of the resin in the grooves will fracture, thus indicating to the consumer that tampering with the container has occurred. A portion of the resin will remain in the grooves to provide a clear, visible indication that the resin was on the closure when it was initially sealed.

In another embodiment, the closure comprises a rotatable portion and a fixed portion. The rotatable and fixed portion have grooves which are filled with a resin. When the rotatable portion is pivoted away from the fixed portion to open the container, a portion of the resin fractures, thus indicating tampering with the container. A portion of the resin also remains in the grooves.

It is an object of the invention to provide a closure which has means indicating tampering with a package.

It is a further object of the invention to provide a closure made of elastic, resilient and/or flexible material which is snap fit onto a container.

It is a further object of the invention to provide the closure with an end wall containing a top layer of resin which fractures to indicate tampering with a package.

It is a further object of the invention to provide a closure which permits stacking one package on top of another without fracturing the resin disposed on the end wall of the closure.

It is a further object of the invention to provide grooves in the surface of the closure end wall underlying the top layer of resin that also contain the resin.

It is a further object of the invention to provide for some of the resin to remain in the grooves after fracturing of the top layer of resin to indicate that the container was originally manufactured with tamperproof resin.

It is a further object of the invention to provide indicia on the end wall which indicates if the top layer of resin has been fractured.

It is a further object of the invention to provide a child resistant container.

It is a further object of the invention to provide a flip top closure which has similar tamper evident resin filled grooves.

These and other objects of the invention will be fully understood from the following description of the invention with reference to the drawings appended to this application.

DESCRIPTION OF THE PREFERRED EMBODIMENTS

Figure 1:
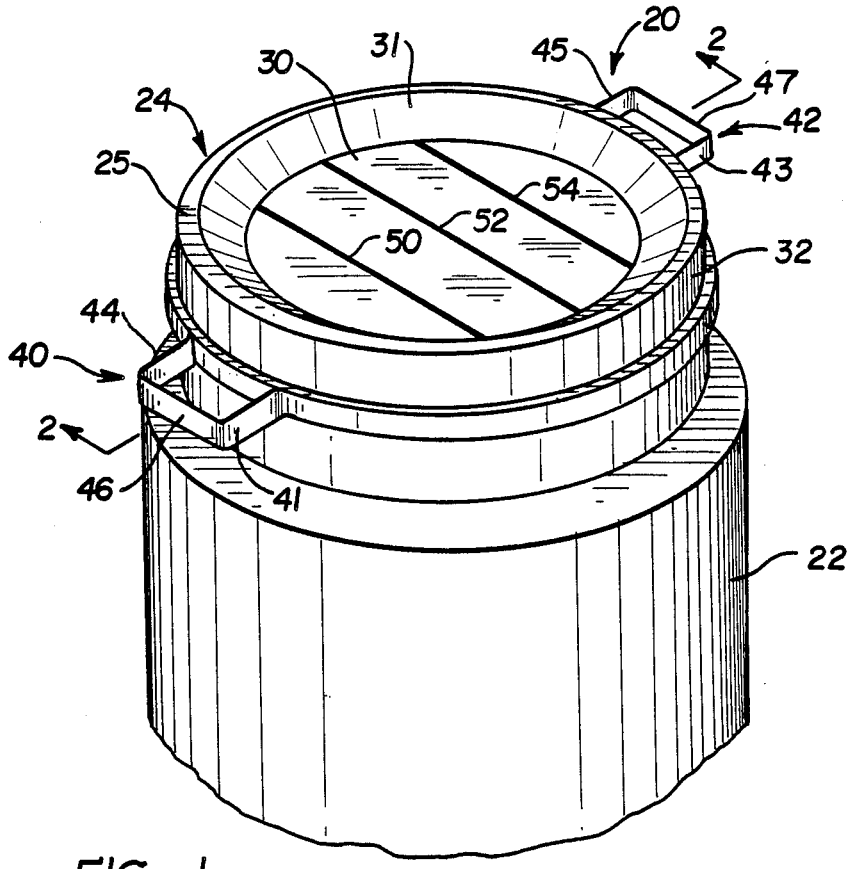
FIG. 1 is a perspective view of a container and closure of one embodiment of my invention.
Figure 2:
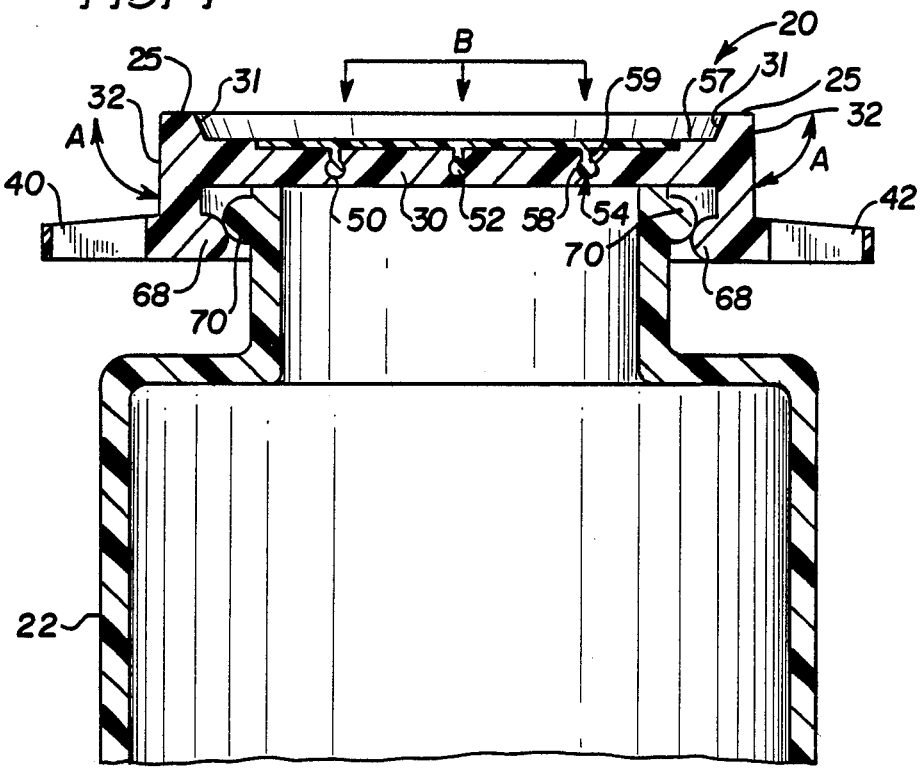
FIG. 2 is a cross-sectional view of the container and closure of FIG. 1 taken through line 2—2 of FIG. 1.

A package illustrating one of the embodiments of my invention is shown in FIGS. 1 and 2. The package 20 consists of a container body 22 and a closure 24. The container body 22 and closure 24 are shown as being generally round in plan, however, any shape can be utilized. The container body 22 can be made of any suitable material such as glass, metal or plastic or combinations thereof, for example. The material is preferably inflexible or inelastic so as to resist reversible deformation of the container body 22 opening. The closure 24 is preferably made of an elastic material which can bend and stretch when being put on and taken off the body 22. This elastic material can be polypropylene, polyethylene, rubber or a flexible metal, for example.

As shown in FIG. 2, the closure 24 has an annular top rim 25 which is spaced from the end wall 30 by annular generally vertically oriented shoulder portion 31 which connects the rim 25 with end wall 30. The shoulder portion 31 is preferably tapered as shown in FIG. 1 or may be a straight vertical edge. The end wall 30 forms a base which will be out of contact with a similar package which is placed on top of package 20. This arrangement will facilitate vertical stacking of the packages, without fracturing a resin layer that is disposed on the end wall 30.

The closure 24 has an annular depending skirt 32 and a pair of ears 40 and 42 which protrude from opposed sides of the lower portion of the annularly depending skirt 32. The ears 40 and 42 can be formed in any desired shape and are preferably integrally formed with the closure 22. The ears 40 and 42, as shown in FIG. 1, have, respectively, two sidewalls 41, 44 and 43, 45 joined by bridging wall 46, 47. The sidewalls 41, 44 and 43, 45 are shown forming an outwardly concave arc. It will be appreciated that any shape, size or form of ears 40 and 42 can be used. These ears 40 and 42 facilitate removing and replacing the closure 24 on the container body 22.

As can be seen in FIGS. 1 and 2, an upwardly open recess 49 and three upwardly open transverse grooves 50, 52 and 54 are formed in the top surface of the closure end wall 30. The recess 49 can be entirely filled with resin or only a portion of the recess 49 can be filled with resin. The recess 49 can have an area equal to or less than the area of the closure end wall 30. FIGS. 1 and 2 shows a resin deposited in the recess 49 and filling the grooves 50, 52 and 54. As can be seen in FIG. 2, the resin completely fills the grooves 50, 52 and 54 and forms a layer in recess 49. It will be appreciated that the resin will cover greater than about 50% of the top surface of closure end wall 30. If desired, a lesser quantity of resin and a lesser coverage percentage can be used, provided that the resin still fractures upon tampering with or adulteration of the container.

The cross-sectional shape of the grooves 50, 52 and 54 is shown in FIG. 2. Groove 54, for example, has a generally bulb-shaped base 58 and a recessed throat portion 59. The restricted throat 59 resists removal of the resin in bulb base 58. This groove shape will facilitate placing the resin into the groove 54. The resin in the bulb-shaped base 58 will remain therein after fracturing of the resin in the throat portion 59 to indicate to the consumer that the package was originally provided with the tamperproof resin. The identical resin is preferably deposited in the recess 49 and grooves 50, 52 and 54 at the same time.

The resin deposited into the recess 49 and the grooves 50, 52 and 54 preferably is ultravioet ray curable to a brittle state. A preferred material is an epoxide resin such as a cycloaliphatic epoxide resin manufactured by Union Carbide Corp. of Danbury, Conn., and sold under the trade designation Envibar 1244. Alternatively, the resin could include a polyester base ultraviolet cured matte sold under the trade designation Polycure by Oriental Intl. of Tokyo, Japan, for example. As another alternative, a premixed ultraviolet light curable acrylate may be used such as, for example, those sold by the Loctite Corporation of Newington, Conn. Other materials of the Envibar line, such as K 231 and K 232 and also UV 1231, for example are suitable.

Cycloaliphatic epoxide products such as those mentioned herein and in my copending U.S. Pat. Application Ser. No. 07/209,822, are low-viscosity, miscible liquids that are easily combined. In order to obtain the appropriate properties with those materials, the resin should include photoinitiators. The process of this combination is sometimes referred to as "formulation". A suitable class of materials are the onium salt photoinitiators, sold under the trade designations CYRA CURE EVI-6974 and CYRA CURE UVI-6990 by Union Carbide Corp. and UVE-1014 and UVE-1016 by General Electric Company. More specifically, the cationic chemistry involved in the curing of adhesives, coatings, inks, and sealants deals with onium salt photoinitiators. These photoinitiators are blocked catalysts that are unblocked by the action of ultraviolet light. When the salts are exposed to ultraviolet light, they photolyze and chemically decompose under the action of ultraviolet light. Subsequently, they generate into a cationic species that acts as a catalyst or an initiator for polymerization of cycloaliphatic epoxides. In the presence of the generated cationic species, very rapid polymerization takes place.

The Envibar 1244 material is a general purpose base epoxide that has an excellent cure response and viscosity differentiation that facilitates formulation. Epoxide materials respond to ultraviolet light cure when they are combined with an appropriate photoinitiator. Aryldiazonium salts and arylidonium salts are suitable photoinitiators. When the base epoxides, such as Envibar 1244, are used alone as the only polymerizing ingredient in a formulation, hard, brittle coatings with good solvent resistance and adhesion result. This result is desirable for purposes of the present invention.

In order to prepare the formulation, the various ingredients may be simply combined or stirred by simple mixing for a suitable period, and then the coating and curing procedures are undertaken. The process should preferably be carried out under "yellow" light conditions in order to protect the preparation from ultraviolet light until curing is performed.

If desired, a material containing the photoinitiator may be employed. One suitable material for this purpose is that sold by Union Carbide under the trade designation ENVIBAR 1244. Another suitable material that can be used is acrylate because of its ability to be cured by short bursts of ultraviolet radiation.

Referring again to FIG. 2, the closure 24 has an inwardly projecting annular rib 68 formed on skirt 32 which is designed to snap fit over an outwardly projecting annular bead 70 disposed on the neck of container body 22 to seal the package 20. In order to remove the closure 24 from the body 22, one or both of the ears 40 and 42 of the closure 24 are bent upward and outward (in the directions of the arrows A on FIG. 2). This will force the annular rib 68 up and over the annular bead 70 thus releasing the closure 24 from the body 22. It will be appreciated that the illustration of two ears on the closure is not meant to be limiting and that no ears or one ear or more than two ears can be provided, if desired.

The action of removing the closure 24 from the body 22 will place downward pressure (shown by arrows B) on the end wall 30 of the closure 24. This downward pressure will in turn fracture the resin in the recess 49 and in the grooves 50, 52 and 54. The fractured pieces of resin may be removed from the end wall 30 or otherwise disposed of. The resin material in the recessed throat portion 59 may also fracture, however, the resin in the bulb-shaped base 58 will remain in the groove 54. This will indicate to a consumer that the package was originally manufactured with the resin.

After the resin fractures it can remain adhered to the closure or it can break into pieces which can fall off or be removed from the closure as desired.

Figure 3:
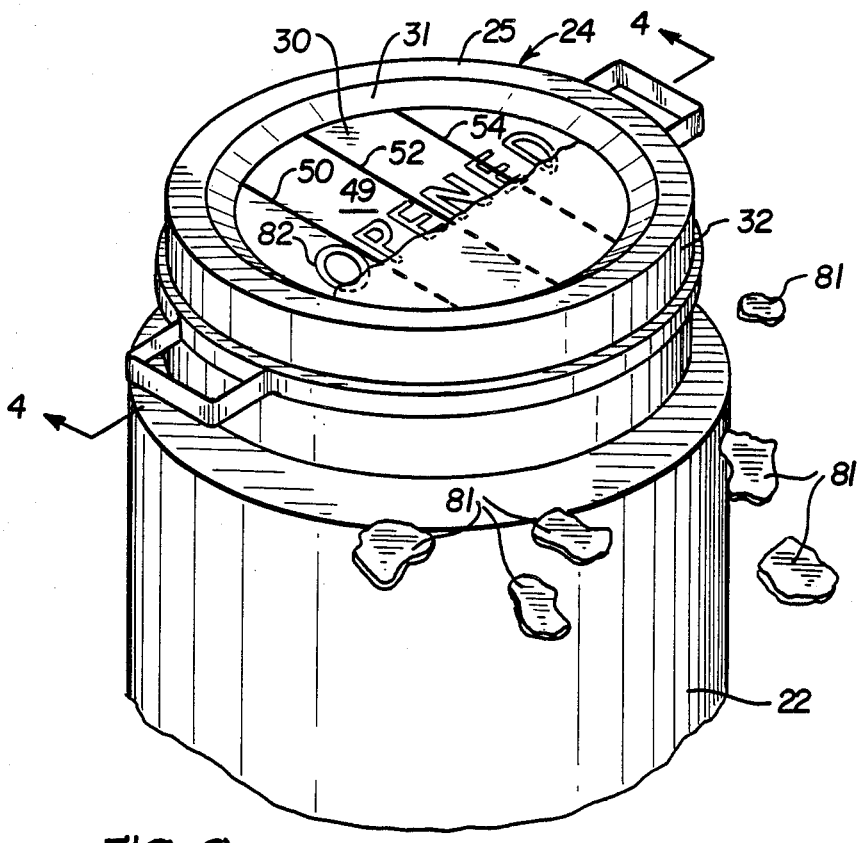
FIG. 3 is a perspective view of a package showing the closure having indicia which is exposed after the resin is fractured.

Referring to FIG. 3, a further embodiment of the tamper evident aspect of the package 20 will be further explained. Once the package 20 reaches the store shelf, the resin in the recess 49 and the grooves 50, 52 and 54 will be intact and will not be fractured. If the package 20 is tampered with by a person trying to lift the closure 24 off of the package 20, the upward and outward action of removing the closure will cause the resin in the recess 49 and in the grooves 50, 52 and 54 to fracture, thus indicating to a consumer that tampering has occurred. As shown in FIG. 3, pieces 81 of the resin will fracture and can be removed or will fall off of the closure end wall 30.

Another feature of the invention is shown in FIG. 3. The closure end wall 30 can have contained thereon indicia 82, such as the word "OPENED" or a skull and crossbones, for example. This indicia is preferably only visible to the consumer after the resin is fractured and falls off of the end wall 30. This can be accomplished by printing the indicia 82 in the same color as the tint of the resin applied to the end wall 30. This way the resin will mask the indicia 82 until such time as the resin fractures and is removed from the end wall.

Figure 4:
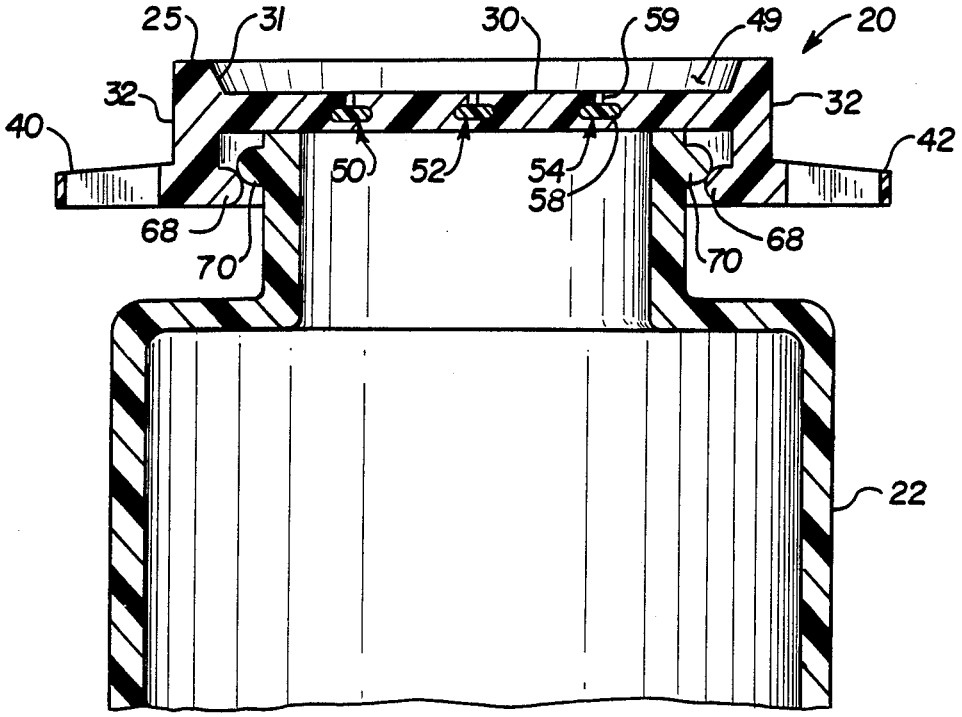
FIG. 4 is a cross-sectional view of the container and closure of FIG. 3 taken through line 4—4 of FIG. 3.

As can be seen in FIG. 4, the resin in the recess 49 and the resin in the throat portions (for example throat portion 59 of groove 54) is no longer present. However, a portion of the resin, after fracturing of the resin, remains in the bulb-shaped portion 58 of groove 54, for example. This shows that after the tampering has occurred and the resin has fractured, there will still remain remnants of the resin in the grooves 50, 52 and 54. This will indicate to the consumer not only that the tampering has occurred, but also that the closure was originally tamperproofed.

The resin filled grooves also act to childproof the container because it takes a certain amount of force to bend the closure and thus break the resin. The amount of force necessary to open the package 20 will depend on the amount of resin disposed in the recess of the end wall 30 as well as the number, shape and size of the grooves in the end wall 30.

Figure 5:
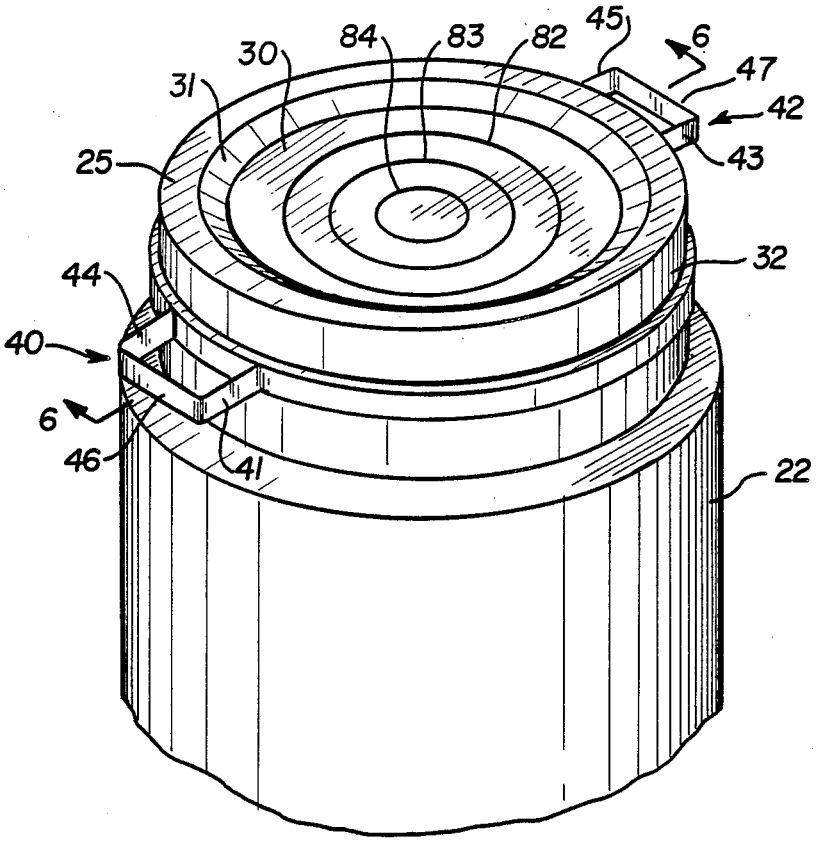
FIG. 5 is a perspective view of a package with a closure having concentric grooves.
Figure 6:
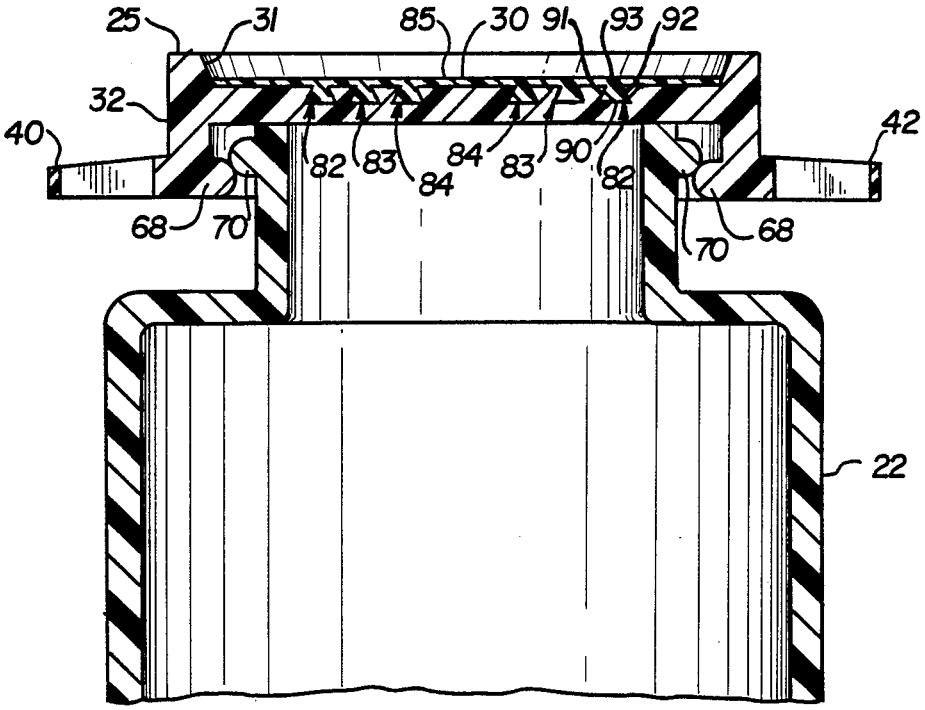
FIG. 6 is a cross-sectional view of the container and closure of FIG. 5 taken through line 6—6 of FIG. 5.

FIGS. 5 and 6 show another embodiment of the closure having a different groove pattern. In this embodiment, the grooves consist of three concentric circles 82, 83 and 84. It will be appreciated that any type of groove pattern can be used for the end wall, such as straight lines, s-curved lines, angled lines, and elliptical lines.

FIG. 6 shows a cross-sectional view of the grooves, 82, 83 and 84. Groove 82 (which is trapezoidal) has a base portion 90 and two upwardly and inwardly disposed sidewalls 91 and 92. The sidewalls 91 and 92 form a throat portion 93 which allows resin to enter the grooves. This cross-sectional shape not only facilitates entry of the resin into the grooves, but also provides a wider portion near the bottom of the groove so that an amount of resin will be present in the groove after the top layer of resin fractures to indicate tampering with the closure.

It will also be appreciated that the groove cross-sectional shape is preferably any pattern having a reversed tapered profile, whereby the base portion is wider than the throat portion so that resin may be deposited therein and so that a portion of the resin remains in the groove after fracturing of the top layer of resin. As explained hereinbefore, this shape will facilitate accomplishing an indication to consumers that the resin was applied when the package was initially manufactured. In the alternative, a groove profile having straight vertical edges forming a narrow groove can also be provided. Any groove profile which facilitates part of the resin fracturing with another part remaining in the groove after fracturing will be acceptable.

Another embodiment of the container is shown in FIGS. 7 to 10. This container 100 has a container body 102 and a closure 104 which is connected to the body 102 by a living hinge 106. The closure body end wall **102*a* has a depending closure body annular skirt 102*b* which in the form shown is received within and secured to the container body. The closure 104 has a closure lid or rotatable portion 108 having a closure lid end wall 104*b* and a closure lid annular skirt 104*c* which depends from the closure lid end wall 104*b*. The closure 104 may have internal serrations 105 that are complementary to external serrations 105*a* on the closure body annular skirt 102*b* so that the closure 104 can be intimately secured to the container 100. Other frictionally engaged surfaces may be employed. The closure 104 consists of a fixed portion 107 and a rotatable portion 108** and may be by an injection molding process, well known to those skilled in the art.

Figure 7:
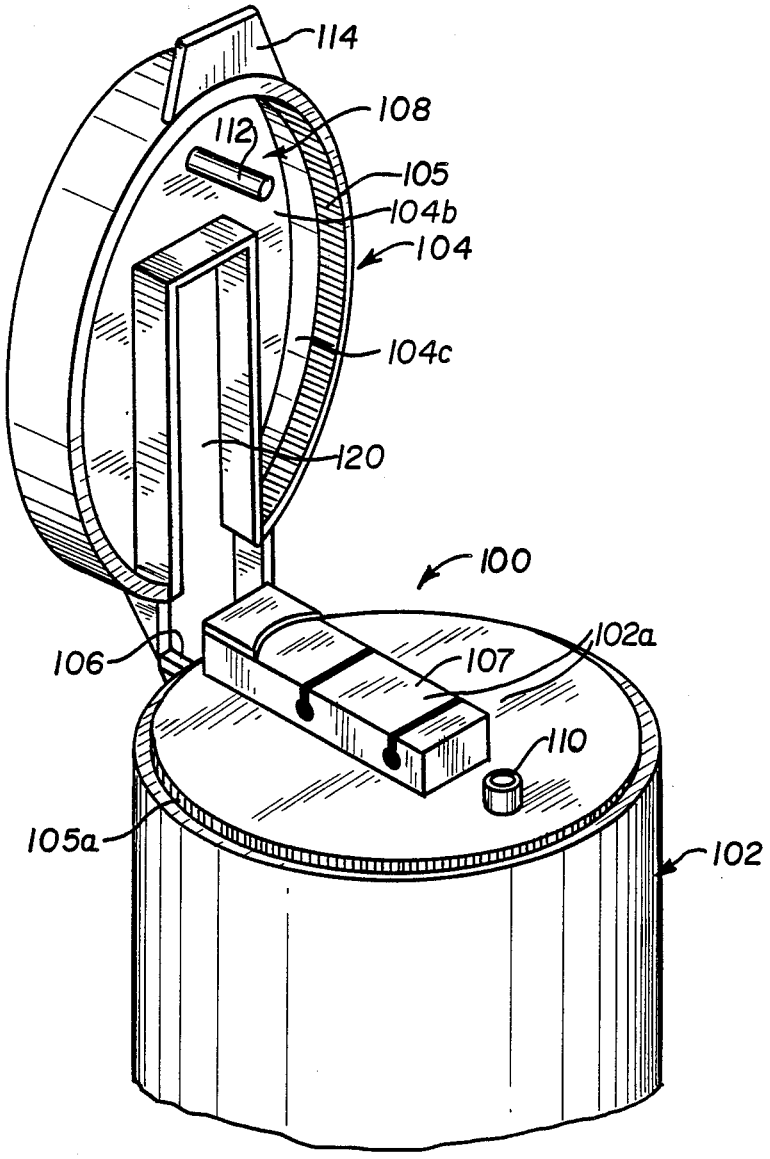
FIG. 7 is a perspective view of another embodiment of the container and closure my invention.
Figure 9:
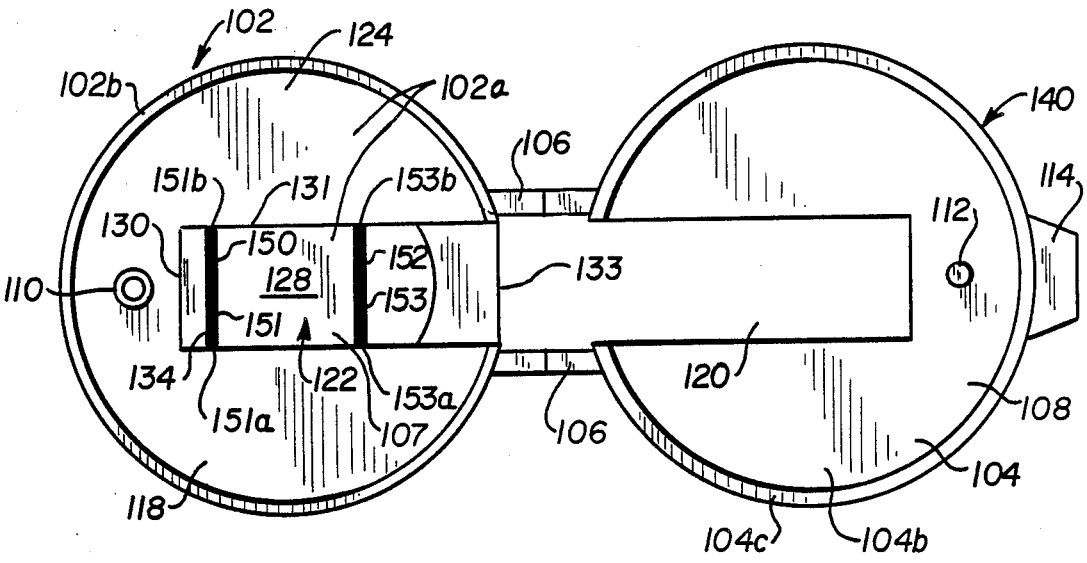
FIG. 9 is a top plan view of the container and closure of FIG. 7 when the closure is in an open position.
Figure 10:
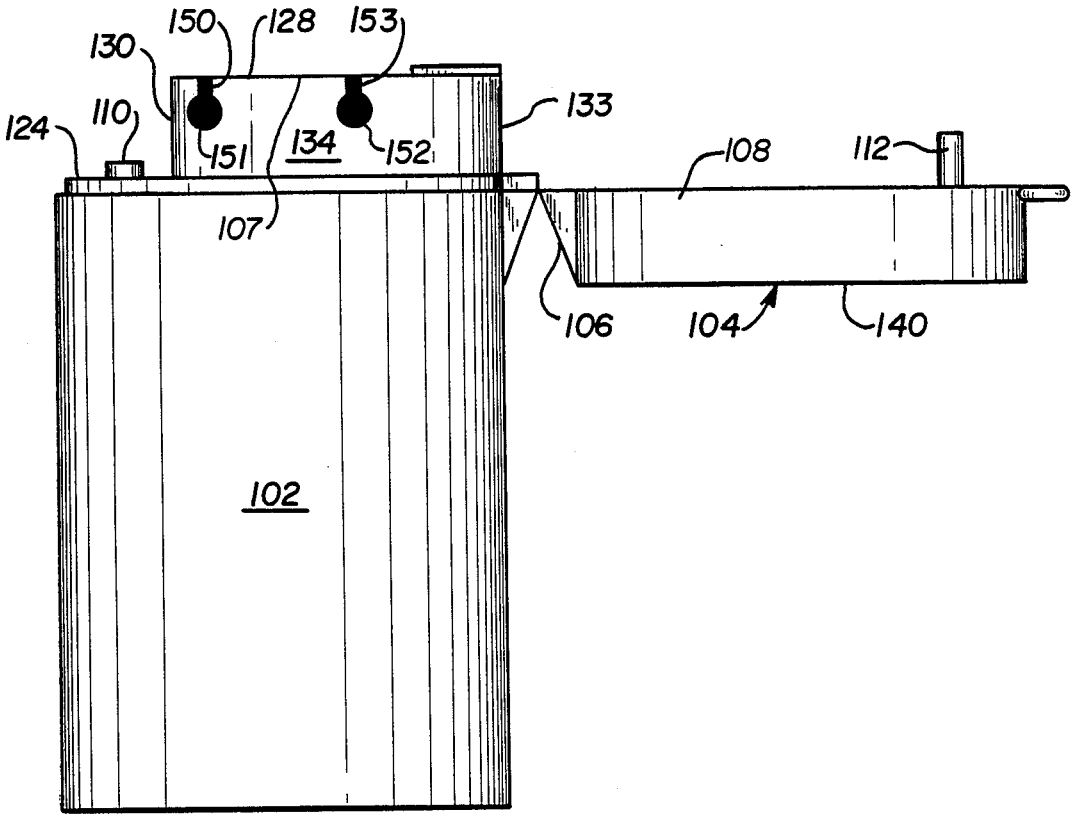
FIG. 10 is a side elevational view of the container and closure as shown in FIG. 9.

In the form shown, the fixed portion 107 has a dispensing opening 110 and the rotatable portion 108 has a form fitting stopper 112. The container 100 will be in a closed position when the rotatable portion 108 is secured to the top of the fixed portion 107. The container 100 will be in an open position where the rotatable portion 108 is pivoted away from the fixed portion 107 (FIGS. 7, 9 and 10). The closure 104 is also equipped with a tab 114 to facilitate pivoting the closure 104 on and off the container body 102.

Figure 8:
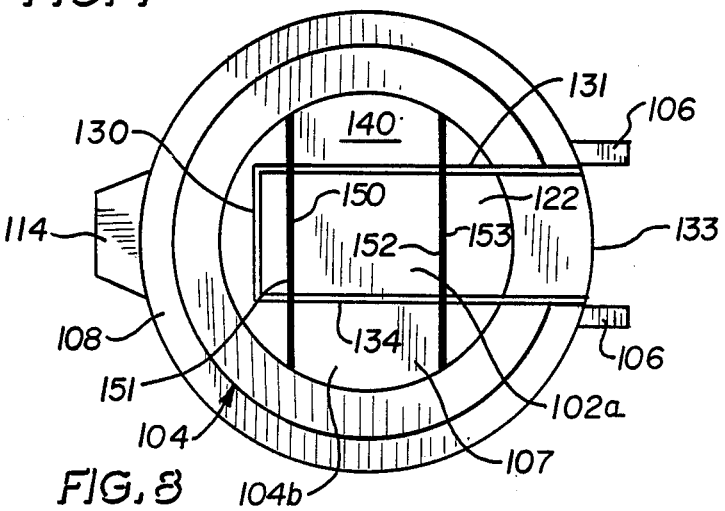
FIG. 8 is a top plan view of the container and closure of FIG. 7 with the closure in a closed position.

Referring now to FIGS. 8 through 10, the rotatable portion 108 defines an opening 120 which receives a portion 122 on the fixed portion 107. Portion 122 extends upwardly from a first surface 124 of the fixed portion 108 and is designed to be surrounded by the closure 104. The fixed portion 122 has an end wall 128 and four sidewalls 130, 131, 133 and 134. The rotatable portion 108 also has an end wall 140. As can be seen in FIG. 8, two grooves 150 and 152, containing the resin described hereinabove and having a cross-sectional shape shown in FIG. 10 (which, in turn, is similar to the grooves 50, 52, 54 described hereinbefore) are provided. These grooves 150 and 152 can take different shapes such as circles, curves or other shapes, for example, and can have different cross-sectional shapes as was discussed hereinbefore with respect to grooves 50, 52 and 54. These grooves 150, 152 are contained on both the fixed portion end wall 128 and the rotatable portion end wall 140.

When the container and the closure 104 are manufactured the resin is placed in the grooves 150 and 152. The resin forms resin bars 151 and 153 in the respective grooves 150 and 152. Container 100 arrives on the store shelf with the resin bars 151 and 153 intact. If the rotatable portion 108 is rotatably removed from the fixed portion 107, the resin in the bars 151 and 153 will each fracture at two locations 151*a* and 151*b* and 153*a* and 153*b*, thus indicating to the consumer that tampering with the package has occurred. As with the embodiment of FIGS. 1 and 2 a further advantage of the container 100 is that even after the tampering occurs and the resin has been fractured and falls off of the container and closure, there still will remain remnants of the resin bars 151 and 153 in grooves 150 and 152. This will indicate to the consumer not only that the tampering occurred but also that the container was originally tamperproof when delivered from the manufacturer.

Additionally, the resin bars 151 and 153 provide child-proofing because of the increased resistance created by regulating the density and the resiliency of the closure in conjunction with the size of the groove, as well as varying the depth of the grooves and the composition of the resin. Varying these factors will determine the amount of force necessary to open the closure.

Although only one type of package shape has been disclosed herein, it will be appreciated that the invention can be used with many different shapes and sizes of packages, holding a wide variety of products such as foods and medication, for example.

Any references herein to orientation such as top, bottom, left, right, upper and lower for example are not limiting, and are used solely for convenience of reference.

Whereas a particular embodiment has been described hereinabove, for purposes of illustration, it will be evident to those skilled in the art that numerous variations of the details may be made without departing from the invention as defined in the appended claims.

I claim:

1. A resilient closure for a container, comprising:
an end wall having at least one upwardly open elongated groove;
an annular skirt depending from said end wall; and
a resin deposited on the top surface of said end wall and in said groove, whereby moving said closure cap away from said container will cause a portion of said resin to fracture.

2. The closure of claim 1, wherein
said groove has a base portion and a restricted throat portion, whereby when said resin fractures a portion of said resin will remain in said base portion.

3. The closure of claim 2, wherein
said groove has a generally truncated cone shape.

4. The closure of claim 2, wherein
said groove has a generally bulb shape.

5. The closure of claim 2, wherein
said top surface has at least two grooves.

6. The closure of claim 5, wherein
said two grooves are generally parallel to each other.

7. The closure of claim 2, wherein
said top surface has a plurality of concentric grooves.

8. The closure of claim 1, wherein
said end wall has a recess and said grooves are formed within said recess.

9. The closure of claim 1, wherein
said end wall top surface has indicia printed thereon, and
said resin obscures said indicia from view after said resin is applied in said indicia.

10. The closure of claim 9, wherein
said resin has a tint that is substantially the same as the color of said printed indicia, whereby said resin will mask said indicia.

11. The closure of claim 10, wherein
said indicia is visible once said resin fractures and falls off said top surface of said end wall.

12. The closure of claim 1, wherein
said resin is a cycloaliphatic epoxide resin.

13. The closure of claim 1, wherein
said container has a neck with external engagement means for receiving said closure cap, and
said skirt having internal engagement means complimentary to said external engagement means for securing said closure cap to said container.

14. The closure of claim 13, wherein
said external engagement means is an annular bead and said internal engagement means is an annular rib.

15. The closure of claim 14, including
at least one projection extending axially from said skirt member to facilitate removing said closure cap from said container.

16. The closure of claim 15, including
a first projection on one side of said closure and a second projection on an opposite side of said closure, whereby said closure may be removed from said container by moving said first and second projections upwardly and inwardly so that said annular rib clears said annular bead.

17. A closure for a container, comprising:
a closure body having a closure body end wall and a closure body annular skirt depending from said closure body end wall;
a closure lid having closure lid end wall and closure lid annular skirt depending from said closure lid end wall;
hinge means pivotally connecting said closure body to said closure lid for rotatable movement of said closure lid away from said closure body;
said closure body end wall having at least one groove segment and said closure lid end wall having at least one groove segment;
said closure body end wall groove segment being aligned with said closure lid end wall groove segment; and a resin deposited in said groove, whereby when said closure lid is rotated away from said closure body portions of said resin will fracture.

18. The closure of claim 17, wherein said closure body end wall has two groove segments with said closure lid end wall groove segment positioned intermediate of said closure body end wall groove segments, whereby when said closure lid is moved away from said closure body, said resin fractures at two points.

19. The closure of claim 18, wherein said groove has a base portion and a restricted throat portion, said restricted throat portion extending from said top surface of said end wall, whereby when said resin fractures a portion of said resin will remain in said base portion.

20. The closure of claim 19, wherein said restricted throat portion is narrower in width than said base portion.

21. The closure of claim 20, wherein said groove has a generally bulb shape.

22. The closure of claim 21, wherein said resin is a cycloaliphatic epoxide resin.

23. The closure of claim 22, wherein said closure lid has tab means depending from said closure lid skirt for use in moving said closure lid away from said closure body.

* * * * *